US008051584B2

(12) United States Patent
Robson et al.

(10) Patent No.: US 8,051,584 B2
(45) Date of Patent: Nov. 8, 2011

(54) SHOE HEEL ASSEMBLY AND METHOD

(75) Inventors: Susan Robson, Hoboken, NJ (US); Paul Genberg, Brooklyn, NY (US)

(73) Assignee: E.S. Originals, Inc., New York, NY (US)

( * ) Notice: Subject to any disclaimer, the term of this patent is extended or adjusted under 35 U.S.C. 154(b) by 890 days.

(21) Appl. No.: 12/080,240

(22) Filed: Apr. 1, 2008

(65) Prior Publication Data

US 2009/0241376 A1 Oct. 1, 2009

(51) Int. Cl.
*A43B 21/28* (2006.01)

(52) U.S. Cl. ..... 36/35 B; 36/35 R; 36/29

(58) Field of Classification Search ..... 36/35 B, 36/35 R, 29, 28, 39, 30 R
See application file for complete search history.

(56) References Cited

U.S. PATENT DOCUMENTS

| | | | | |
|---|---|---|---|---|
| 22,755 | A * | 1/1859 | Thorp | 36/39 |
| 182,648 | A * | 9/1876 | Larrison | 36/36 R |
| 1,404,822 | A * | 1/1922 | Williams | 36/39 |
| 3,181,254 | A * | 5/1965 | Cowen | 36/39 |
| 5,363,570 | A * | 11/1994 | Allen et al. | 36/28 |
| 6,354,020 | B1 * | 3/2002 | Kimball et al. | 36/29 |
| 7,950,168 | B2 * | 5/2011 | Nakano | 36/28 |
| 2006/0130365 | A1 * | 6/2006 | Sokolowski et al. | 36/35 R |
| 2006/0283046 | A1 * | 12/2006 | Mason | 36/28 |

* cited by examiner

*Primary Examiner* — Ted Kavanaugh
(74) *Attorney, Agent, or Firm* — Kirschstein, et al.

(57) ABSTRACT

A shoe outsole has a heel post extending outwardly therefrom. An outer heel cover has a hole for receiving the heel post in an assembled position. The heel post thus acts as a convenient positioning guide for the heel cover. A plurality of fluid-filled heel cushioning members at least partly surrounds the heel post between the outsole and the cover in the assembled position, for cushioning heel impacts during use of the footwear. A plurality of dividers on the outsole extend radially of the heel post, and position each cushioning member between a pair of the dividers. The dividers thus act as convenient positioning guides for the cushioning members. The cushioning members have different resistances to compression for adjustably cushioning heel impacts during use of the footwear.

8 Claims, 1 Drawing Sheet

SHOE HEEL ASSEMBLY AND METHOD

BACKGROUND OF THE INVENTION

1. Field of the Invention

The present invention generally relates to shoe heels and to methods of manufacturing the shoe heels.

2. Description of the Related Art

A shoe generally consists of an upper attached to a sole. The upper encloses a foot and typically includes an insole to provide initial support and cushioning to a bottom of the foot. An outsole is the ground-contacting portion of the sole and includes a heel. The outsole provides traction, stability, and protection to the remainder of the shoe. Outsoles are composed of durable materials, such as rubber, to provide high abrasion wear resistance. A midsole, if used, is composed generally of a softer, more flexible material than the outsole.

The increase in demand for shoes for sports and outdoor activities such as walking, running, hiking, and playing tennis, basketball and like sports has prompted many advances in shoe design to improve protection and comfort to the feet, ankles, legs, hips, etc., especially to improve cushioning, shock absorption, and stability at the heel. Efforts to improve cushioning at the heel, while maintaining adequate stability, have incorporated various gels in an attempt to enhance and prolong cushioning and energy return. However, soles incorporating gels are costly to manufacture and relatively unpredictable in their functional characteristics. Although the functional characteristics of the shoe are of primary importance, other factors such as the cost of manufacture and appearance of the shoe must also be taken into account for full consumer satisfaction.

SUMMARY OF THE INVENTION

Object of the Invention

Accordingly, it is a general object of this invention to provide a novel shoe heel assembly of adjustable cushioning and aesthetic appearance, as well as to provide a cost-effective method of manufacturing the shoe heel assembly

Features of the Invention

In keeping with the above object and others which will become apparent hereinafter, one feature of the present invention resides, briefly stated, in a heel assembly for footwear, that includes an outsole having a heel post extending outwardly from the outsole, an outer heel cover, preferably constituted of a wear-resistant material, having a hole for receiving the heel post in an assembled position, and a heel cushioning component at least partly surrounding the heel post between the outsole and the cover in the assembled position, for cushioning heel impacts during use of the footwear. The heel post thus acts as a convenient positioning guide for the heel cover.

In a preferred embodiment, the heel cushioning component includes a plurality of fluid-filled cushioning members spaced apart angularly around the heel post. The outsole has a plurality of dividers extending radially of the heel post and spaced angularly apart, and each cushioning member is positioned between a pair of the dividers. The dividers thus act as convenient positioning guides for the cushioning members. The outer heel cover is preferably adhesively mounted on the cushioning members in the assembled position, and the cushioning members are also adhesively mounted on the outsole in the assembled position.

Each cushioning member is preferably a sealed cushion filled with air. Each sealed cushion includes a pair of juxtaposed sheets, each sheet of the pair having a plurality of indentations extending toward the other sheet of the pair. The indentations of the sheets of each pair abut, and are integrally connected to, each other. Each indentation preferably has a generally hemispherical shape, and the indentations of the sheets of each pair are integrally connected to each other at common welds laying in a plane centrally between the sheets.

In accordance with another feature of the present invention, the sealed cushions have different resistances to compression, for example, by being filled with air at different pressures. This feature enables the shoe to be designed with adjustable cushioning against heel impacts during use of the footwear.

Yet another feature of the present invention resides in a method of manufacturing a heel assembly for footwear, comprising the steps of forming a heel post that extends outwardly from an outsole, mounting a heel cushioning component on the outsole in an assembled position in which the heel cushioning component at least partly surrounds the heel post, and mounting an outer heel cover on the heel cushioning component in the assembled position by receiving the heel post in a hole in the outer heel cover. The heel post thus acts as a convenient positioning guide and holder for the heel cover and reduces the cost of manufacture.

The cost of manufacture is further reduced by configuring the heel cushioning component as a plurality of fluid-filled cushioning members, by spacing the cushioning members apart angularly around the heel post, by forming a plurality of dividers on the outsole to extend radially of the heel post, by spacing the dividers angularly apart, and by positioning and holding each cushioning member between a pair of the dividers.

In order to adjustably cushion heel impacts during use of the footwear, the cushioning members are advantageously provided with different resistances to compression. Thus, the stiffness or softness of each cushioning member is controllable and selectable at different areas of the heel.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
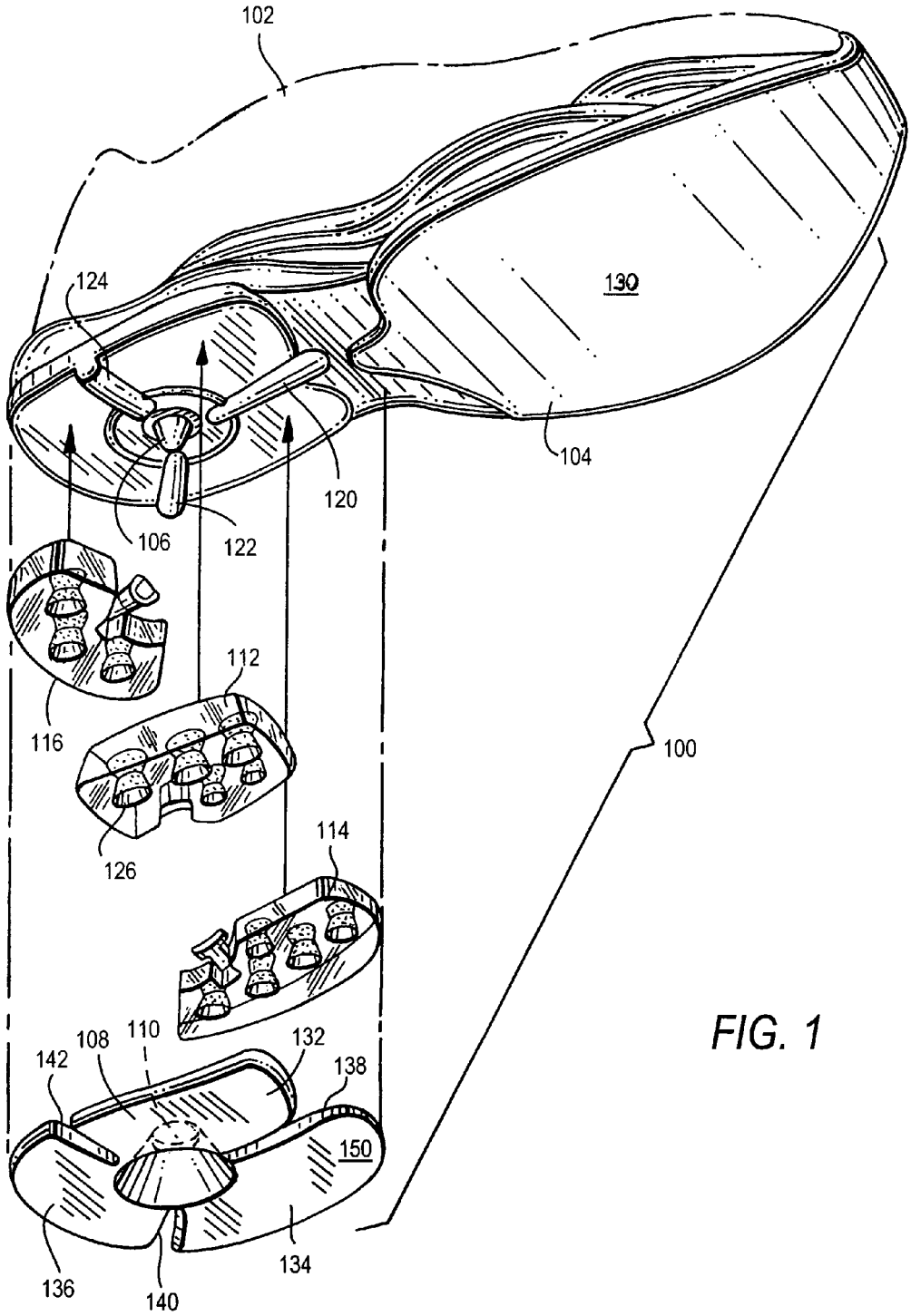
FIG. 1 is an exploded view of a heel assembly manufactured in accordance with the present invention.

An exemplary embodiment of a shoe 100 providing enhanced shock protection against heel impacts in accordance with the present invention is illustrated in the exploded view of the sole FIG. 1. The shoe illustrated comprises one half of a symmetrical pair of footwear of a type that is commonly worn during sports and outdoor activities, such as walking, running, hiking, and playing tennis, basketball and like sports.

The shoe 100 comprises a soft, flexible upper 102 that conformably surrounds an upper portion of a wearer's foot (not illustrated), and a sole 104 that is attached to the upper and thereby held between the wearer's foot and the ground or other contact surface (not illustrated). The upper 102 of the shoe 100 conventionally includes an opening through which the wearer's foot (not illustrated) is inserted into the shoe, a toe box, a vamp, a tongue, a pair of flaps disposed on opposite sides of and overlapping the tongue, and a lace extending through eyelets (not seen) in the flaps to secure the shoe on the wearer's foot, in a conventional manner. The upper may incorporate a laminated construction comprising sewn and/or bonded layers of soft, flexible leathers, plastic and/or cloth, and may have an interior surface that is padded for additional comfort.

The sole 104 includes an insole (not illustrated), a midsole (not illustrated), and an outsole that preferably comprises a strong, resilient, wear-resistant elastomer of compression-molded, synthetic rubber, e.g., neoprene or polyurethane. The outsole functions to absorb, i.e., store and dissipate, a portion of the shock and impact forces acting on the wearer's foot, but its primary functions are to increase the frictional coefficient between the shoe and the ground or other contact surface, thereby affording the wearer's foot with a non-slipping "traction", for which its lower surface 130 may be provided with cleats, lugs, lands and grooves, or the like (not illustrated), and to resist wear-abrasion of the lower surface of the shoe caused by its frictional engagement with the contact surface.

In accordance with one feature of the present invention, a heel post 106 extends outwardly from the sole 104. The heel post 106 need not be cylindrical or integral with the sole 104 as shown, but can instead be any projection. An outer heel cover 108, preferably constituted of a wear-resistant material, has a hole 110 for receiving the heel post 106 in an assembled position. The heel post 106 thus acts as a convenient positioning guide and holder for the heel cover 108. A heel cushioning component, preferably comprising a plurality of fluid-filled cushioning members 112, 114, 116, at least partly surrounds the heel post 106 between the sole 104 and the cover 108 in the assembled position, for cushioning heel impacts during use of the footwear. More or less than the three illustrated cushioning members could be employed. The cushioning members may be separate, discrete members as illustrated, or a single member with a plurality of sections.

In a preferred embodiment, the cushioning members 112, 114, 116 are spaced apart angularly around the heel post 106. The sole 104 has a plurality of dividers 120, 122, 124 extending radially of the heel post 106 and spaced angularly apart, and each cushioning member 112, 114, 116 is positioned between a pair of the dividers 120, 122, 124. The dividers 120, 122, 124 thus act as convenient positioning guides and holders for the cushioning members 112, 114, 116. The outer heel cover 108 is preferably adhesively mounted on the cushioning members 112, 114, 116 in the assembled position, and the cushioning members 112, 114, 116 are also adhesively mounted on the sole 104 in the assembled position. During the adhesive mountings, the dividers and the post are especially useful, because they hold the cushioning members and the heel cover in place while the adhesive cures and sets.

The heel cover 108 is preferably divided into sections 132, 134, 136 that overlie the cushioning members 112, 114, 116 respectively in the assembled position. The sections 132, 134, 136 are separated by slits 138, 140, 142 that overlie the dividers 120, 122, 124. The dividers 120, 122, 124 are visible through the slits 138, 140, 142 in the assembled position. A lower surface 150, just like the lower surface 130, may be provided with cleats, lugs, lands and grooves, or the like (not illustrated), to resist wear-abrasion of the lower surface of the heel cover 108 caused by its frictional engagement with the contact surface.

Each cushioning member 112, 114, 116 is preferably a sealed cushion filled with air. Each sealed cushion includes a pair of juxtaposed sheets, each sheet of the pair having a plurality of indentations, e.g., 126, extending toward the other sheet of the pair. The indentations 126 of the sheets of each pair abut, and are integrally connected to, each other. Each indentation 126 preferably has a generally hemispherical shape, and the indentations 126 of the sheets of each pair are integrally connected to each other at common welds laying in a plane centrally between the sheets.

Each cushion can be constructed through molding sheets of plastic resin in molds configured with protrusions to provide the indentations in the material. One mechanism for forming each cushion is through thermoforming. Generally, thermoforming is a process of shaping plastic resin by heating a sheet or film of the plastic to a temperature at which the resin is sufficiently pliable to be shaped into a desired form and then forcing the material into a one-sided mold. Each cushion is preferably constructed by heating a first thermoplastic sheet to its forming temperature, heating a second thermoplastic sheet to its forming temperature, forcing the first thermoplastic sheet into a first mold configured to provide an upper molded sheet, forcing the second thermoplastic sheet into a second mold configured to provide a lower molded sheet, and joining together the two molded sheets by bonding, gluing, welding, fusing, coupling or the like. The molded sheets are configured to indent either or both of the upper and lower molded sheets at selected points or areas to provide internal support members. A particularly preferred construction method is to close together the upper and lower molded sheets while the material is at its forming temperature such that the upper and lower molded sheets are fused or welded together at their contact points or areas.

As indicated, each cushion is preferably constructed of a thermoplastic resin. Preferable materials are those which are easily thermoformable into desired flexible configurations. Materials which can be thermoset after molding and retain the flexible characteristics for the sole components of the present invention are included within the scope of preferred thermoformable materials. Thermoset resins solidify or set irreversibly when heated due to crosslinking between the polymer chains. Crosslinking can be achieved by using nucleating agents, mold temperatures above the materials forming temperature, radiation, etc. A thermoset resin once set or cured cannot be softened again by heating. Thermoset resins are generally characterized by high thermal stability, high dimensional stability and high rigidity and hardness and include resins such as polyesters and urethanes.

Thermoplastic resins can be either crystalline or amorphous and can be repeatedly softened by heating. Amorphous thermoplastics include acrylonitrile-butadienestyrene (ABS) copolymer, styrene, cellulosics and polycarbonates. Crystalline thermoplastics include nylons, polyethylene, polypropylene and polyurethane. Examples of particularly preferred materials for use in the present invention include thermoplastic polyurethanes, nylons, polyesters, polyethylenes, polyamides and the like.

In accordance with another feature of the present invention, the cushioning members 112, 114, 116. are sealed cushions having different resistances to compression, for example, by being filled with air, or other gas, or liquid at different pressures, e.g., below, at, or above atmospheric pressure, or by controlling the number, size and/or configuration of the indentations 126. The indentations 126 make that part of the cushion stiffer in compression than another part of the cushion without the indentations. For example, a difference in stiffness for compression between the medial side of the shoe and the lateral side of the shoe can be achieved. Or, a smaller hemispherical radius may be used for the indentations on one side of the shoe. These variations may be used to provide effective pronation or supination control through differences in compression between the medial and lateral sides of the shoe.

Thus, the stiffness or softness of each cushioning member is controllable and selectable at different areas of the heel. This feature enables the shoe to be designed with adjustable cushioning against heel impacts during use of the footwear.

It will be understood that each of the elements described above, or two or more together, also may find a useful application in other types of constructions differing from the types described above.

While the invention has been illustrated and described as embodied in a heel assembly and a method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. A heel assembly for footwear, comprising:

an outsole having a heel post extending outwardly from the outsole;

an outer heel cover having a hole for receiving the heel post in an assembled position; and a heel cushioning component at least partly surrounding the heel post between the outsole and the cover in the assembled position, for cushioning heel impacts during use of the footwear, the heel cushioning component including a plurality of fluid-filled cushioning members spaced apart angularly around the heel post.

2. The assembly of claim 1, wherein the outsole has a plurality of dividers extending radially of the heel post and spaced angularly apart, and wherein each cushioning member is positioned between a pair of the dividers.

3. The assembly of claim 1, wherein the outer heel cover is constituted of a wear-resistant material.

4. The assembly of claim 1, wherein the outer heel cover is adhesively mounted on the cushioning members in the assembled position, and wherein the cushioning members are adhesively mounted on the outsole in the assembled position.

5. The assembly of claim 1, wherein each cushioning member is a sealed cushion filled with air.

6. The assembly of claim 5, wherein each sealed cushion includes a pair of juxtaposed sheets, each sheet of the pair having a plurality of indentations extending toward the other sheet of the pair, and wherein the indentations of the sheets of each pair abut, and are integrally connected to, each other.

7. The assembly of claim 6, wherein each indentation has a generally hemispherical shape, and wherein the indentations of the sheets of each pair are integrally connected to each other at common welds laying in a plane centrally between the sheets.

8. The assembly of claim 1, wherein the cushioning members are sealed cushions having different resistances to compression.

* * * * *